US005727575A

United States Patent [19]

Rontal

[11] Patent Number: 5,727,575

[45] Date of Patent: Mar. 17, 1998

[54] HAIR SECURING DEVICE

[76] Inventor: Rik Rontal, 803 Plata Rd., Arroyo Grande, Calif. 93420

[21] Appl. No.: 664,955

[22] Filed: Jun. 13, 1996

[51] Int. Cl.[6] ..... A45D 24/00

[52] U.S. Cl. ..... 132/200; 132/273

[58] Field of Search ..... 132/273, 274, 132/275, 200; 54/78, 79.2; 2/174, 171, 195.1, 195.2, 195.3, 207; 119/850, 809, 810, 811; D28/39, 40, 41

[56] References Cited

U.S. PATENT DOCUMENTS

| | | | |
|---|---|---|---|
| D. 31,285 | 7/1899 | McClellan . | |
| D. 42,828 | 7/1912 | Vieweg . | |
| 127,918 | 6/1872 | Parson et al. . | |
| 148,367 | 3/1874 | Howard . | |
| 209,737 | 11/1878 | Weide . | |
| 1,111,935 | 9/1914 | Wright . | |
| 1,276,052 | 8/1918 | Gensch | 132/57.1 |
| 2,651,310 | 9/1953 | Selson | 132/274 |
| 3,452,759 | 7/1969 | Sarinelli . | |
| 4,378,667 | 4/1983 | Velarde, Jr. | 54/78 |
| 5,025,613 | 6/1991 | Connors | 54/78 |
| 5,062,256 | 11/1991 | Kingett et al. | 54/78 |
| 5,462,020 | 10/1995 | Trimmer | 119/850 |
| 5,465,741 | 11/1995 | Dvorak | 132/275 |
| 5,472,003 | 12/1995 | Frame et al. | 132/275 |
| 5,495,828 | 3/1996 | Solomon et al. | 119/850 |
| 5,595,199 | 1/1997 | Solomon et al. | 132/273 |

*Primary Examiner*—Gene Mancene
*Assistant Examiner*—Pedro Philogene
*Attorney, Agent, or Firm*—Marvin E. Jacobs

[57] ABSTRACT

A fabric panel for wrapping around and enclosing a ponytail having a top edge, a bottom edge substantially parallel to the top edge, and two substantially parallel lengthwise side edges. Ties are provided for removably securing the fabric panel around the ponytail. The device is removably anchored to the ponytail by at least one comb secured to the inner surface on top of the fabric panel.

15 Claims, 2 Drawing Sheets

HAIR SECURING DEVICE

TECHNICAL FIELD

The present invention relates to a hair securing device that is particularly suited to hair styled as a "ponytail".

BACKGROUND OF THE INVENTION

Both men and women now wear long hair. As these people engage in active sports, they must secure their hair to prevent it from obscuring their vision. This becomes a safety factor in sports such as riding a motorcycle. Furthermore, grit and dirt can be blown into the hair when traveling on highways.

Present practice is to pull the hair back from the face and either braid the hair into a tail or pull the hair together and secure it with a rubber band near the head to form a pony tail. Motorcycle riders and passengers must wear helmets. The long tail does not fit into conventional full helmets and is below the rear edge of short helmets. Most riders wrap the hair tail in a scarf. However, the forces of wind buffeting the hair tail when traveling at high speeds usually loosens the scarf which blows away and is lost. The scarf does not form a complete closure for the hair and the hair inside the scarf becomes fouled with dirt, smoke, exhaust fumes, etc.

LIST OF REFERENCES

| U.S. Pat. No. | Patentee |
|---|---|
| 31,285 | McCLELLAN |
| 127,918 | PARSON, et al. |
| 148,367 | HOWARD |
| 209,737 | WEIDE |
| 1,111,935 | WRIGHT |
| 3,452,759 | SARINELLI |
| 4,378,667 | VELARDE, Jr. |
| 5,062,256 | KINGETT, et al. |
| 5,462,020 | TRIMMER |
| 5,465,741 | DVORAK |
| 5,472,003 | FRAME, et al. |

STATEMENT OF THE PRIOR ART

Only a few devices are known for wrapping human hair for decorative, control and sanitary purposes. A number of devices are available for wrapping animal tails, and more particularly horse tails, for show or animal husbandry purposes.

Dvorak (U.S. Pat. No. 5,465,741) describes a women's Hair Wrap Device comprising a flexible fabric cover with an elastic band secured in one end and a ribbon attached at its midpoint to the cover adjacent to the elastic element. In use the ponytail is inserted through the elastic band to the extent desired and the tension thus developed between the elastic band and the hair is intended to secure the cover to the hair. The fabric cover is then wrapped around the ponytail and secured by lacing the ribbon around the cover and tying in a bow. Dvorak's device also includes various decorative articles, such as beads, attached to the ends of the lacing ribbons.

Another human hair retainer is described by Frame and Frame (U.S. Pat. No. 5,472,003) comprising a continuous tubular sleeve with open ends, or with one end closed. Various methods are provided for securing the sleeve to the ponytail. These include elastic bands or ribbons, and cords or other inelastic ties which are secured around the sleeve in a variety of common configurations. The length of the sleeve can match the length of the ponytail or it can be longer with the excess length taken up by gathering the sleeve into "billowed" sections between securing ties. In the open ended configuration, the hair may extend past the sleeve ending. In the closed end configuration, the lower portion of the ponytail is fully enclosed by the sleeve. Frame and Frame describe that the sleeve may be made from any flexible material known. Decorative articles may also be attached to the securing cords.

Kingett and Kingett (U.S. Pat. No. 5,062,256) describe a tubular cover for a horse's tail. The cover is formed from a single cloth panel with opposing lengthwise edges attached to each other via VELCRO (hook and loop) fasteners. In the Kingett and Kingett configuration, the tubular cloth cover is formed by folding the lengthwise ends of the flat cloth panel over and around the horse's tail and pressing together the VELCRO fasteners. The cover is secured to the horse, not the tail, by a strapping arrangement looped around the horse's neck and extending down the horse's back to the dock of the tail. At the dock, the strap is attached to the cover by additional VELCRO fasteners.

A removable animal tail cover is disclosed by Trimmer (U.S. Pat. No. 5,462,020) comprising an elongate horse's tail cover with alternate methods of gripping the tail. Trimmer's preferred embodiment secures the cover to the tail just below the dock by a cord which is attached to the cover and encircles the tail. Tightening and tying the cord compresses the cover onto the hair portion of the horse tail thus securing the cord and cover to the tail. The gripping of the cover to the tail may be enhanced by an encircling elastic cord incorporated into the cover and friction materials placed between the securing cord and the tail. The area of the tail above the gripping area is covered by an extension of the fabric cover supported by a tube stiffener made from semi-flexible material, preferably plastic, or polyethylene.

All of the described prior art devices relating to protecting and or decorating ponytails, both human and animal, suffer limitations pertaining to the secure attachment of the protecting or decorative device to the hair. Most of the earlier, described devices depend on the frictional engagement of the cover with the hair as typically provided by elastic bands, cords, ribbons and the like. Alternatively, as in the case of certain animal tail covers, methods for preventing slippage of the cover from the tail involve complex strap and loop arrangements connecting the cover to the body of the animal, most frequently the neck. These techniques are subject to slippage of the cover down the length of the ponytail (or tail) particularly when the wearer is exercising or otherwise engaged in vigorous activity.

STATEMENT OF THE INVENTION

The hair tail securing device of this invention comprises a tubular wrap for the ponytail such as a fabric panel usually having a length longer than its width. The width is sufficient to totally enclose the hair tail in at least one layer of fabric, preferably two layers of fabric. After the panel is rolled around the pony tail, the exterior side edge is secured, suitably by fasteners along its length. An anchoring means such as a comb is secured to the inner top edge of the panel is pushed downwardly into the tail and resists downward forces pulling on the wrapped panel especially if the ponytail is retained by an elastic band such as a rubber band and the teeth of the comb are inserted from a position above the band into the hair. The elastic band will act as a brake and prevent downward movement of the comb. Furthermore, the width of the comb is preferably no more than ½ the width of the panel to permit multiple wraps of the panel, usually about ⅓ to 1/12 the width thereof.

This invention overcomes the key limitations of the prior art by incorporating a positive attachment apparatus which cooperates with the hair of the user to anchor the hair wrapping device or hair cover to the user. In the preferred embodiment of this invention the attachment of the hair securing device, or hair cover, is achieved by permanently incorporating a comb type appliance into the top portion of the fabric panel. This appliance engages the hair at the desired point of attachment. As is well known, a comb will securely engage hair as a result of its interference interaction with the naturally occurring entwining of hair strands. If the hair is braided or plaited the engagement is even more secure. However, braids or plaits are not required for the comb to effectively secure the wrap to the tail. As the hair wrap is blown and is pulled away from the head, the teeth of the comb are pulled into the hair of the user to anchor the assembly. The attachment of the appliance is even more secure when the ponytail is first secured with an elastic band.

The hair securing device of the invention is formed from materials that meet the often conflicting demands for protecting hair from damaging and harmful environments while simultaneously controlling the hair during vigorous exercise and providing an aesthetically pleasing appearance.

These and many other features and attendant advantages of the invention will become apparent as the invention becomes better understood by reference to the following detailed description when considered in conjunction with the accompanying drawings.

DETAILED DESCRIPTION OF THE INVENTION

Figure 1:
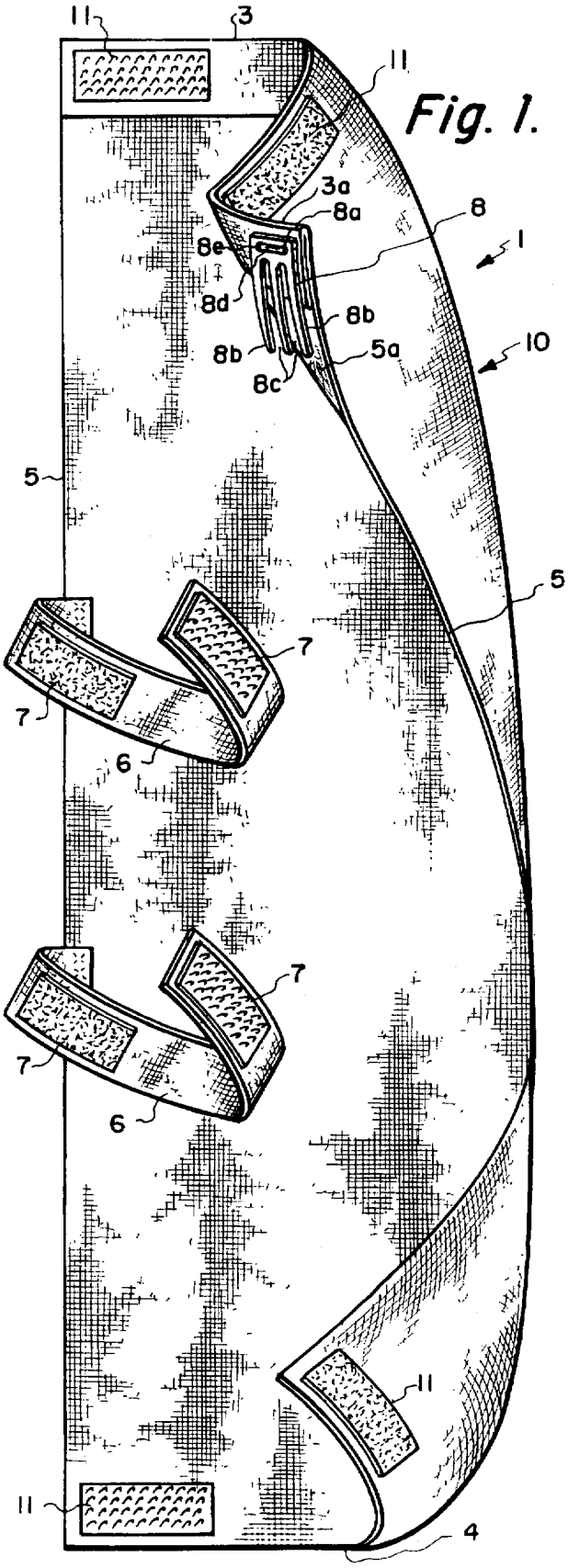
FIG. 1 is a front view in elevation of a first embodiment of the hair wrapping device of the invention.

Referring now to FIG. 1, a fabric panel 1 for wrapping around and enclosing a ponytail 2 is shown having a top edge 3, a bottom edge 4 substantially parallel to the top edge 3, and two substantially parallel lengthwise side edges 5. Means for removably securing the fabric panel around the ponytail comprises at least one fastening strap 6, having a set of cooperating fasteners such as hook and loop fasteners 7 on a lengthwise outside edge 5 of the panel 1. Additionally, FIG. 1 shows an anchoring means such as a comb type appliance 8 secured to inner surface 3*a* of the panel 1 adjacent the top edge 3 and inner side edge 5*a* of the fabric panel 1 for removably attaching the fabric panel 1 to the ponytail 2. The comb comprises a top band 8*a* from which a plurality of teeth 8*b* extend. The teeth 8*b* preferably curve toward the inside surface of the panel 1 and preferably contain long slots 8*c* through which hair can enter. The top band 8*a* is secured to the panel 1 by thread 8*e* being sewn through apertures 8*d* in the band 8*a* of the comb 8.

Figure 2:
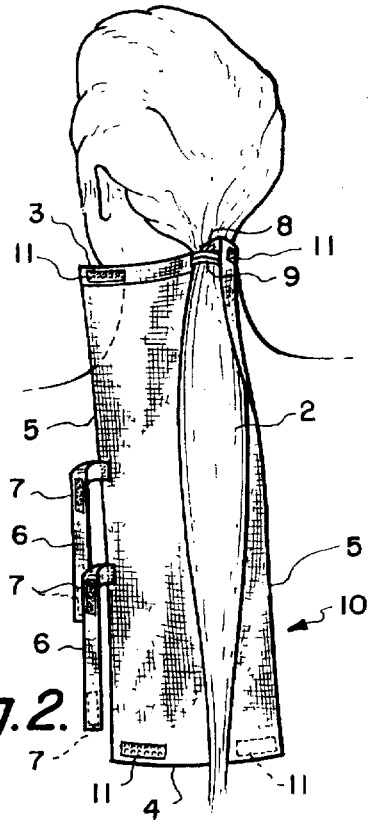
FIG. 2 is a plan view of hair wrapping device shown open with the comb inserted into a pony tail.
Figure 3:
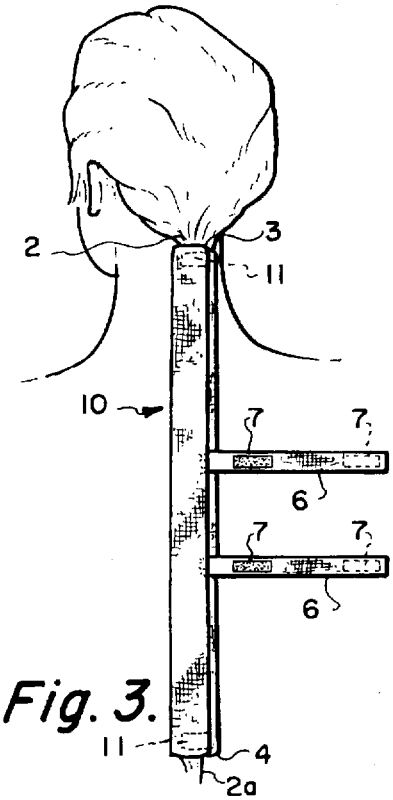
FIG. 3 is a plan view of the hair wrapping device with the ponytail extending past the lower end of the device and the fastening straps shown in extended position.

Continuing reference to FIG. 1, the hair wrap device is used by first styling the hair into a ponytail 2. The pony tail 2 can be contained by common "bobbypins", elastic bands 9 or the like. The hair may also be braided or plaited into a ponytail. Next the teeth 8*c* of the comb type appliance 8, as shown in FIG. 2, are firmly inserted into the body of the ponytail 2 at the desired position for the upper portion of the hair wrapping device 10. The fabric panel 1 is then wrapped around the ponytail as tightly or loosely as desired and then secured by pressing together the cooperating hook and loop fasteners 11 proximate to the top edge 3 and bottom edge 4 of the fabric panel 1. The hair wrapping device 10 can be further secured with the fastening straps 6, again by pressing together the cooperating hook and loop fasteners 7. Two straps are shown in FIG. 1 however the device of this invention is equally useful with only one, or multiple, fastening straps. The placement of the cooperating hook and loop fasteners 7 on opposite sides of the fastening straps 6 is clearly depicted in FIG. 3. Typically, a short portion 2*a* of the ponytail may extend past the bottom edge 4 of the fabric panel 1 after it is wrapped around the ponytail 2.

Other methods for securing the hair wrapping device 10 include ribbon and cord ties secured to the fabric panel 1, snap fasteners, buttons, and others selected from of a large variety of known fasteners.

Figure 4:
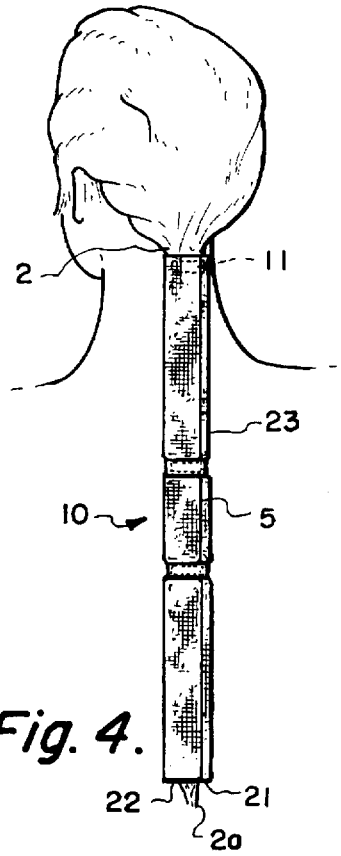
FIG. 4 is a plan view of another embodiment of a hair wrapping device with the lower edge of the hair wrapping device formed into a permanent open tube.

FIG. 4 shows another embodiment of the hair wrap device wherein the bottom edge 4 of fabric panel 1 is formed into a permanently secured open tube 21 through which the lower extremity 2*a* of the ponytail 2 extends. In this embodiment, the hook and loop fasteners 11 are omitted from the bottom edge 4 of the panel 1. The permanent open tube 21 may be formed by any of a large number of methods. Most frequently the tubular opening 22 would be formed by appropriately stitching the fabric. Alternatively the permanently open tube may be formed, for example, by rivets, adhesives, or by thermal bonding. The fabric is wrapped and overlapped in the stitched open end 21 and permanent creases 23 can be formed in the fabric facilitating insertion of the hair and wrapping the panel around the ponytail.

Figure 5:
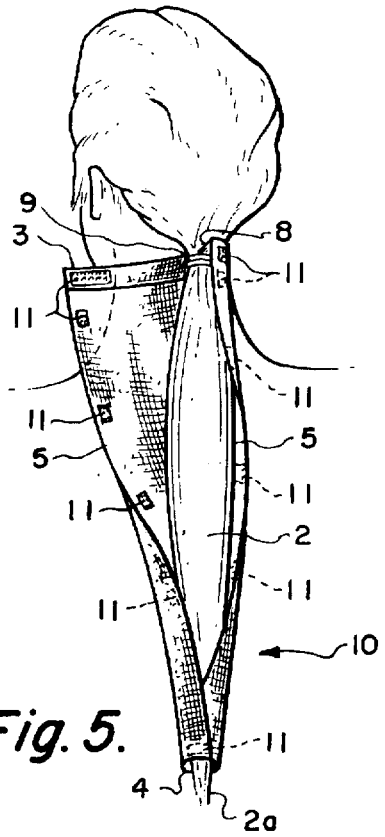
FIG. 5 is plan view of a further embodiment of the hair wrapping device with opposed patches of cooperative fastening devices on the side edges of the device.

Referring now to FIG. 5, a further embodiment of the hair wrapping device 10 is shown that has a top edge 3, a bottom edge 4 substantially parallel to the top edge 3, and two substantially parallel lengthwise side edges 5. A plurality of hook and loop fasteners 11 are placed on the top edge 3, the bottom edge 4 and the lengthwise side edges 5. Additionally, a comb type appliance 8 on the top edge 3 of the fabric panel 1 is used to removably anchor the fabric panel 1 to the ponytail.

Figure 6:
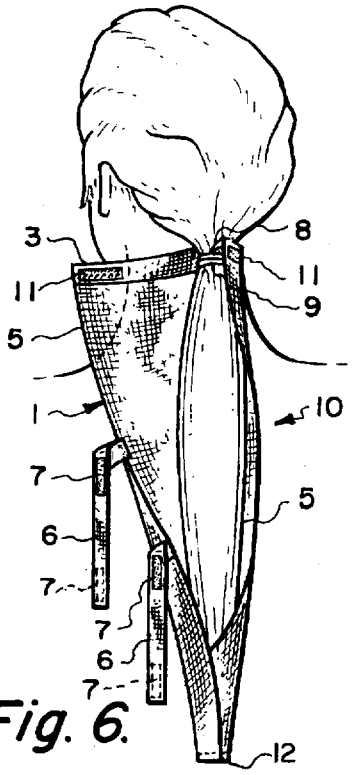
FIG. 6 is a plan view of a further embodiment of a hair wrapping device with the lower end permanently closed.

Another embodiment is shown in FIG. 6. In this arrangement, the hair wrapping device 10 has a closed bottom end 12. This is particularly useful when it is desired to fully protect or isolate the ponytail, or when this appearance is desirable for aesthetic purposes. The hair wrapping device 10 is secured to the ponytail 2 by a comb type appliance 8. The fabric panel 1 is secured after wrapping with the combination of hook and loop fasteners 11 on the edges of the panel, and the hook and loop fasteners 7 on the fastening straps 6. The wrapped fabric panel of this configuration, i.e. with the closed bottom end 12, may also be secured by the method shown in FIG. 5 and described above.

Figure 7:
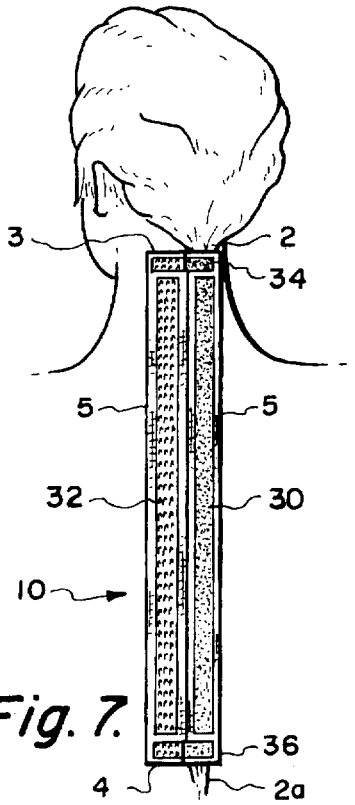
FIG. 7 is a plan view of yet another embodiment of a hair wrapping device with continuous strips of cooperative hook-loop fastening material on opposed edges of the panel of material forming the device.

In the further embodiment shown in FIG. 7, the hair device 10 has continuous lengthwise strips 30, 32 of cooperation hook and loop fastener adhered to the lengthwise edges 5 of the panel of material 1. Strips 34 of fastening material adjacent the top edge 3 are used to close the top of the device 10 and strips of fastening material 36 adjacent the bottom edge 4 are used to close the bottom of the device 10.

The fabric panel of the hair device may be formed from any flexible material that is sufficiently pliable to be wrapped around the ponytail. These materials may be woven or non-woven natural fibers, woven or non-woven synthetic polymer fibers, flexible laminates, leather and other appropriate materials. The material may be solid and impervious, such as a synthetic plastic film or rubberized sheet. Conversely, the material may be a conventional cotton, wool or synthetic woven fabric in a tight weave, open weave, or even netting. The panel can be formed of transparent plastic sheet.

As is readily apparent from the above descriptions and accompanying figures, this invention provides unique methods of protecting, enclosing, containing and decorating hair wrapping devices. In particular the use of a comb type appliance establishes a firm and last attachment with the ponytail, whether or not it is braided. The attached to a braided ponytail is of course the most secure. Although the specific intended use for this invention is for the ponytails of both males and females, it may also be productively used for animal tails, most frequently, horse tails.

The hair device of this invention could be used by cosmetologists or beauticians to isolate the ponytail while the frontal hair is being colored or waved. The devices when made of porous material could be used to isolate and hold the ponytail while it is being dyed, bleached or otherwise treated with cosmetic materials.

The wrap of the invention will find use in activities other than motorcycling such as bicycling, sailing, skiing, snowboarding, hang gliding or sail boarding.

The hair device of this invention is also well suited to various decorative treatments. The fabrics of course may have any of myriad designs available from commercial sources. Example include plaids, checks, paisleys, flower patterns, geometric designs, stripes, and much more. Alternatively, the fabric material may be selected for hand painting, "tie-dying", and other artistic treatments. Beads, pins, rings, feathers, may also be attached, either removably or permanently.

It is to be realized that only preferred embodiments of this invention have been described, and that numerous substitutions, modifications, alterations, and applications are permissible without departing from the spirit and scope of the invention as defined in the following claims.

I claim:

1. A human ponytail hair securing device comprising:

a fabric tube formed from a fabric panel having a width which wraps around said ponytail for receiving and enclosing a human ponytail having an interior cavity and a top edge; and a comb for removably anchoring said fabric tube to said ponytail connected to the interior of said tube and affixed proximate to the top edge of said fabric tube, said comb having a width no more than ½ the width of the top edge of the fabric panel, whereby the panel forms multiple wraps around said ponytail.

2. The device according to claim 1 in which the comb has a width no more than ⅓ the width of the top edge of the panel.

3. The device according to claim 2 in which the comb has a top band and includes a plurality of teeth depending from said band.

4. The device according to claim 3 in which the teeth are curved.

5. The device according to claim 4 in which the teeth contain elongated slots.

6. The device according to claim 1 wherein said panel has a top edge, a bottom edge and inner side edge and an outer side edge and further including means for removably securing said fabric panel around the ponytail comprising:

cooperating fasteners placed proximate to the top edge of said fabric panel;

cooperating fasteners placed proximate to the bottom edge of said fabric panel; and at least one fastening strap secured to one of the outer side edge of said fabric panel and the strap having cooperating fasteners.

7. The device according to claim 6 in which at least one of said cooperating fasteners is a hook and loop fastener.

8. The device according to claim 6 wherein the bottom edge of said fabric panel is permanently formed into an open tube whereby the ponytail may inserted through the open tube and thus extend beyond the bottom edge of the wrapped fabric panel.

9. The device according to claim 6 wherein the bottom edge of said fabric panel is permanently formed into a closed tube whereby the ponytail is completely contained with the wrapped fabric panel.

10. The device according to claim 6 wherein said means for removably securing said fabric panel around the ponytail comprises cooperating hook and loop fasteners placed proximate to the bottom edge of said fabric panel.

11. The device according to claim 1 wherein said fabric panel is formed from at least one material selected from the group consisting of woven and non-woven natural fibers, woven and non-woven synthetic polymer fibers, flexible laminates and leather.

12. A method of protecting a human ponytail from forces of wind comprising:

inserting a comb attached to the inner top edge of a fabric panel into the ponytail, said comb having a width not more than ⅓ the width of the panel;

said fabric panel having a top edge, a bottom edge substantially parallel to the top edge, two substantially parallel lengthwise inner and outer side edges, and a width;

wrapping the panel multiple times around the ponytail; and securing the outer side edge to said wrapped panel to form a tube.

13. A method according to claim 12 in which an elastic band is applied around the ponytail before the comb is inserted into the band from a position above the band.

14. The method according to claim 12 wherein said tube panel is secured around the ponytail by wrapping a fabric strip around said tube:

attaching cooperating hook and loop fasteners placed proximate to the top edge of said fabric panel;

attaching cooperating hook and loop fasteners placed proximate to the bottom edge of said fabric panel; and securing hook and loop fasteners attached to at least one fastening strap attached to one of the lengthwise edges of said fabric panel.

15. The method according to claim 12 wherein said fabric panel is formed from at least one material selected from the group consisting of woven and non-woven natural fibers, woven and non-woven synthetic polymer fibers, flexible laminates and leather.

* * * * *